United States Patent [19]

Solomon

[11] 4,267,656

[45] May 19, 1981

[54] COPY HOLDER

[75] Inventor: Jack Solomon, Long Beach, N.Y.

[73] Assignee: Esselte Pendaflex Corp., Garden City, N.Y.

[21] Appl. No.: 72,179

[22] Filed: Sep. 4, 1979

[51] Int. Cl.[3] ..... B41J 11/14

[52] U.S. Cl. ..... 40/352; 33/437; 33/DIG. 1

[58] Field of Search ..... 40/352, 353, 356; 33/DIG. 1, 437, 430

[56] References Cited

U.S. PATENT DOCUMENTS

| | | | |
|---|---|---|---|
| 2,568,575 | 9/1951 | Wickman | 33/DIG. 1 |
| 2,763,241 | 9/1956 | Waggoner | 40/352 |
| 3,089,464 | 5/1963 | Mendels | 40/352 |
| 3,137,072 | 6/1964 | Terry | 33/DIG. 1 |
| 3,153,400 | 10/1964 | Mendels | 40/352 |
| 4,024,662 | 5/1977 | Krulwich | 40/352 |

*Primary Examiner*—John F. Pitrelli
*Attorney, Agent, or Firm*—Darby & Darby

[57] ABSTRACT

An improved copy holder comprises a stand and a line guide movably attached to the stand by means of magnetic rollers rotatably mounted side by side with their flats in coplanar relation and their rolling surfaces aligned perpendicular to the line guide for rolling magnetic contact parallel with a side of the stand.

2 Claims, 3 Drawing Figures

COPY HOLDER

BACKGROUND OF THE INVENTION

This invention relates to copy holders and, in particular, to a copy holder having improved means for movably securing a line guide to the copy holder stand.

Copy holders are known which have a magnetic slide for securing a line guide to the copy holder stand. However, such copy holders are characterized by sliding friction and scratching noises produced by movement of the magnetic slide over the metal guide surface or track at the side of the copy holder stand. Accordingly, it is a principal object of the invention to provide a line guide that is magnetically secured to the copy holder stand but which is characterized by reduced friction and noise in the movement of the line guide. It is a further object of this invention to provide a magnetic line guide which is durable and easily assembled.

In accordance with the invention, a copy holder comprises a stand having a planar support surface, a metal track or edge running alongside and parallel to the support surface, and a line guide in rolling magnetic contact with the metal edge. The line guide includes a ruler extending across the support surface and a housing fixed to one end of the ruler rotatably mounting a pair of magnetic, toroid-shaped rollers side by side with their flats in coplanar relation and their rolling surfaces aligned perpendicular to the ruler. In a preferred embodiment of the invention, the rollers consist of magnets each sandwiched concentrically between two metal pole pieces having a diameter slightly greater than that of the magnets. Springs are provided for resiliently mounting the rollers in alignment with a wall of the housing.

These features and further aspects and advantages of the invention are described in detail below in conjunction with the drawings of which:

DETAIL DESCRIPTION

Figure 1:
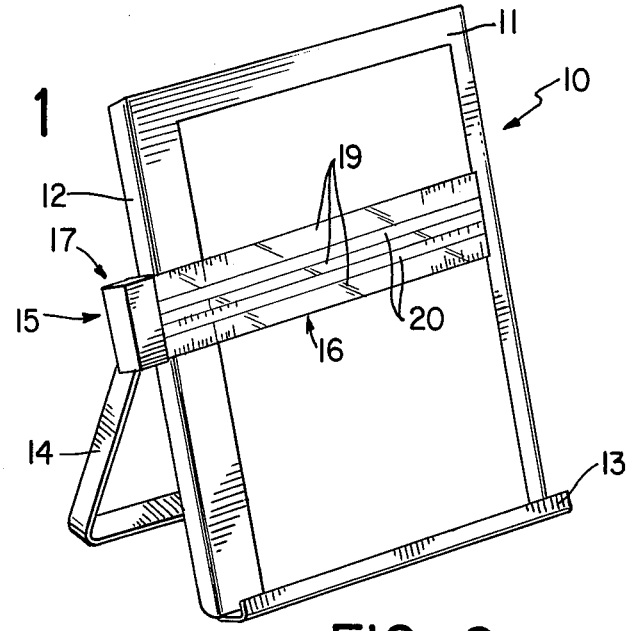
FIG. 1 is a perspective view of one illustrative form of the copy holder according to the present invention.

Referring to FIG. 1, a copy holder has a stand 10 supported at an upright angle for presenting a sheet of copy comfortably within the field of vision of the viewer. The stand has a support surface 11 for the copy and a track or edge 12 of metal along one side of and parallel with the support surface 11. In the preferred embodiment, the edge 12 forms a right angle with the surface 11 and extends over the usable length thereof. A lip 13 is provided at the base of the stand for holding the sheet or sheets of copy, and an adjustable backrest 14 positions the stand at the proper reading angle.

Figure 2:
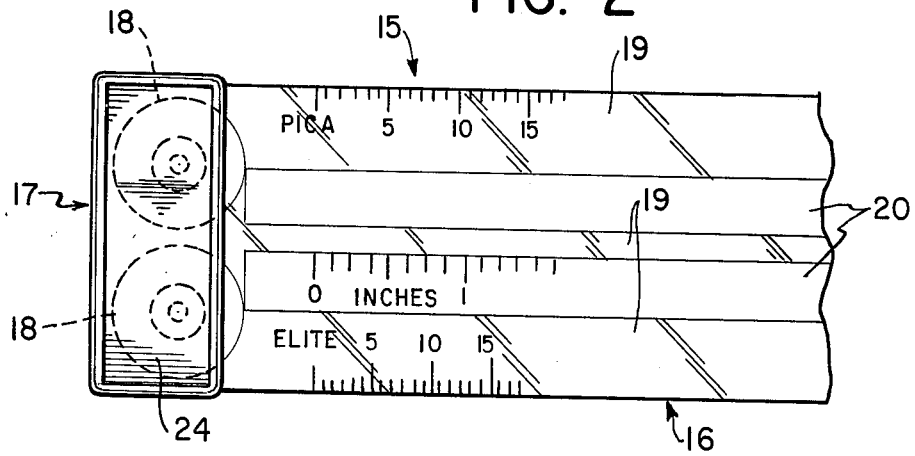
FIG. 2 is a partial plan view of a preferred embodiment of the line guide according to the invention.
Figure 3:
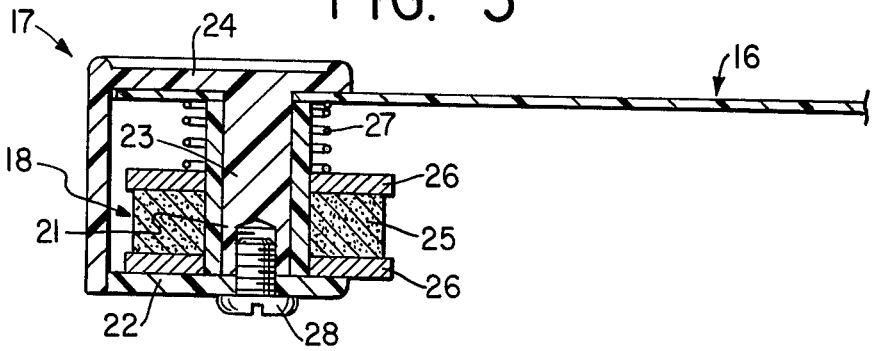
FIG. 3 is a partial horizontal sectional view of the line guide shown in FIG. 2.

The improved line guide 15 for use in conjunction with the copy holder stand according to the invention is shown in detail in FIGS. 2 and 3. The line guide has a ruler 16 extending horizontally across and flush with the support surface 11. One end of the ruler is secured to a housing 17 which has a pair of magnetic rollers 18 for magnetically holding the line guide 15 to the copy holder stand. The ruler 16 is made preferably of a lightweight plastic material which has sufficient rigidity for holding a sheet to the stand and maintaining a linear edge across the stand. Transparent portions 19 allow the viewer to read copy beneath the ruler, and semi-transparent lines 20 on the ruler guide the viewer in reading copy. Measurement indicators in inches or centimeters, fractions thereof, and other measurements such as Pica and Elite type spacing may also be provided.

Shown in FIG. 3 are the magnetic rollers 18 for securing the line guide 15 to the edge 12 such that the ruler is properly aligned across the support surface 11. The rollers are mounted below the plane of the ruler 16 with a portion of their rolling surfaces extending beyond the housing 17 in order to make magnetic contact with the stand. To permit smooth tracking and maintaining the ruler linearly across the support surface once the housing is located, the rollers are arranged coplanar with their points of rolling contact aligned perpendicular to the ruler. The separation between magnetic contact points and the spacing of the rollers beneath the ruler 16 ensure that the line guide will not separate from the stand or pivot about one end when moved by the user, and that the rollers will track in a manner holding the ruler 16 against the support surface 11.

The rollers have bores through their centers wherein they are journalled for rotation on tubular sleeves 21 fixed to the lower wall 22 of the housing. The sleeves 21 pass through the respective bores of the magnetic rollers and fit telescopingly over the posts 23 projecting from the opposite wall 24 of the housing. Provided with apertures for insertion of the posts 23 therethrough, the end of the ruler 16 is clamped within the housing 17 between the tubular sleeves 21 and the upper wall 24.

Each roller consists of a toroid-shaped magnet 25, oriented with its north and south poles running through the flats, sandwiched concentrically between two metal pole pieces 26 which concentrate the holding strength of the magnet at the points of contact. The pole pieces have a diameter slightly greater than that of the magnet in order to present hard points of rolling contact with substantially eliminates friction in the movement between line guide and copy holder stand. The pole pieces also prevent damage, wear, and de-magnetization of the magnets, particularly where they are made from compound or frangible materials. The magnetic rollers are resiliently held in place in alignment against the lower wall 22 by means of conical springs 27 fitted over the tubular sleeves 21. In the assembly of the line guide housing and magnetic rollers, the posts 23, having threaded bores in their ends, are aligned against apertures in the lower wall 22 and secured by means of threaded screws 28 tightened from the outside. The rollers can thus be assembled or disassembled and replaced conveniently.

By this unique construction of the magnetic rollers and line guide housing, the friction and noise incident to movement between the line guide and stand is substantially eliminated. Further, the resilient mounting of the rollers 18 causes them to roll smoothly, hold still within the housing when located at a viewing position, and track substantially in a straight line. These characteristics permit the line guide to be moved up and down in relation to the support surface of the stand with a tap of the finger. Once located, it keeps its position without slipping or creeping and holds the sheet or sheets of copy while maintaining the proper registration with horizontal lines of copy thereon.

It is expressly understood that the embodiments of the invention disclosed herein are for illustrative purposes only, and that this disclosure shall not be construed to limit the scope of the invention, all readily ascertainable modifications and variations being also included within the spirit and letter of the invention as defined in the appended claims.

What is claimed is:

1. A copy holder comprising a stand having a support surface, a metal edge extending along at least one side of the support surface, a line guide extending across the support surface, a line guide housing disposed along an end portion of the line guide and in movable registration with the metal edge of the support surface, said housing including at least a pair of magnetic rollers rotatably mounted within the housing, each roller including a magnet having a North pole and a South pole and means for magnetically and rotatably contacting each magnetic pole with the metal edge, said means disposed adjacent said poles, the magnets of each roller are toroid shaped, the means for magnetically and rotatably contacting the North and South pole of each magnet with the metal edge comprises metallic, concentric end pieces rotatably engaged with the magnets at their poles, the diameter of the end pieces is greater than the diameter of the magnets and the magnetic rollers are biased in rotatable alignment against an inner wall of the housing.

2. A line guide for use with a copy holder comprising a housing, a ruler, means for securing one end of the ruler to the housing, and at least a pair of magnetic rollers each having a North pole and a South pole, rotatably mounted within the housing, each roller including a toroid shaped magnet rotatably mounted side-by-side said magnets having outer, rolling, surfaces aligned relatively perpendicular to the ruler for rolling magnetic contact with an edge of the copy holder, each magnet is concentrically disposed at its North and South poles and rotatably engaged between metallic pieces having a diameter slightly greater than that of each magnet and biasing means for resiliently mounting each magnet in rotatable alignment against a wall of the housing.

* * * * *